US007958577B2

(12) United States Patent
Chang

(10) Patent No.: US 7,958,577 B2
(45) Date of Patent: Jun. 14, 2011

(54) SHOWER CURTAIN HANGING STRUCTURE

(76) Inventor: Shih-lin Chang, Tainan (TW)

( * ) Notice: Subject to any disclaimer, the term of this patent is extended or adjusted under 35 U.S.C. 154(b) by 1006 days.

(21) Appl. No.: 11/755,259

(22) Filed: May 30, 2007

(65) Prior Publication Data

US 2008/0295240 A1 Dec. 4, 2008

(51) Int. Cl.
*A47K 3/38* (2006.01)
*A47H 1/142* (2006.01)
*A47H 1/02* (2006.01)

(52) U.S. Cl. ..... 4/610; 4/558; 4/608; 248/251; 248/261

(58) Field of Classification Search ..... 4/557, 558, 4/607–610; 248/251, 261, 264; 211/105.1–105.4; D8/363, 376
See application file for complete search history.

(56) References Cited

U.S. PATENT DOCUMENTS

| | | | | |
|---|---|---|---|---|
| 4,754,504 | A * | 7/1988 | Cellini | 4/610 |
| 6,216,287 | B1 * | 4/2001 | Wise | 4/610 |
| 6,694,543 | B2 * | 2/2004 | Moore | 4/610 |
| 6,715,163 | B1 * | 4/2004 | Cunningham | 4/558 |
| 2005/0268394 | A1 * | 12/2005 | Monk et al. | 4/558 |
| 2008/0078018 | A1 * | 4/2008 | Hanley et al. | 4/558 |

* cited by examiner

*Primary Examiner* — Darren W Gorman
(74) *Attorney, Agent, or Firm* — WPAT, P.C.; Anthony King

(57) ABSTRACT

A shower curtain hanging structure includes a fixture, a first socket, a second socket and a linking rod. The fixture is provided with a connecting unit to secure the first socket. The second socket is accommodated in the first socket and linked with the connecting unit. The linking rod is composed of several sections, with the two ends connected to the second socket to form the hanger. The first socket is adjustable to link the second socket for the linking rod in a different length.

7 Claims, 10 Drawing Sheets

A–A

SHOWER CURTAIN HANGING STRUCTURE

BACKGROUND OF THE INVENTION

1. Field of the Invention

This invention relates to a shower curtain hanging structure, and more particularly to a linking rod composed of a number of sections.

2. Description of the Related Prior Art

A conventional shower curtain hanger, such as U.S. Pat. No. 6,216,287, as shown in FIG. 10, comprises a pair of wall mountings A attached to the wall and a curved rod B between the wall mountings A. The curved rod B has a long length which takes large space to store. Each wall mounting A has a circular lip A1 which should be shaped to match the curved rod B, that requires more labor hour and increases the cost.

SUMMARY OF THE INVENTION

According to the present invention, there is provided a shower curtain hanging structure comprising:

- a fixture, said fixture comprising a connecting unit, said connecting unit comprising a threaded section having one end formed with a groove;
- a first socket, said first socket having a neck section and inner threads for engagement of said threaded section of said connecting unit;
- a second socket accommodated in said first socket, said second socket comprising an insertion block corresponding to said groove of said connecting unit; and
- a linking rod, said linking rod comprising a pair of straight sections at two ends and two curved sections extending from said straight sections, said straight section being connected to said second socket, a connecting device being disposed between said two curved sections.

Preferably, said connecting unit is pivotally connected to said fixture by means of pins provided at respective sides of said connecting unit.

Preferably, said fixture has a restraining opening to receive and restrain said connecting unit.

Preferably, said fixture is provided with a locking member.

Preferably, one of said two curved sections of said linking rod has a larger diameter end than that of the other curved section for connection of said two curved sections.

Preferably, said two curved sections are formed with holes and said connecting device comprises an elastic element and a lid, said lid being secured in said holes of said two curved sections.

Preferably, said second socket comprises a pair of protuberances on respective outer sides thereof, and said straight sections of said linking rod are formed with slots for engagement of said protuberances.

It is the primary object of the present invention to provide a shower curtain hanging structure, which provides a linking rod composed of a number of sections that takes less space to store when not in use.

It is another object of the present invention to provide a shower curtain hanging structure, which is easy to carry.

It is still another object of the present invention to provide a shower curtain hanging structure, which is easy to operate.

It is a further object of the present invention to provide a shower curtain hanging structure, which is able to do a micro adjustment in its length.

It is still a further object of the present invention to provide a shower curtain hanging structure, which is cost-effective.

DETAILED DESCRIPTION OF THE PREFERRED EMBODIMENT

Figure 1:
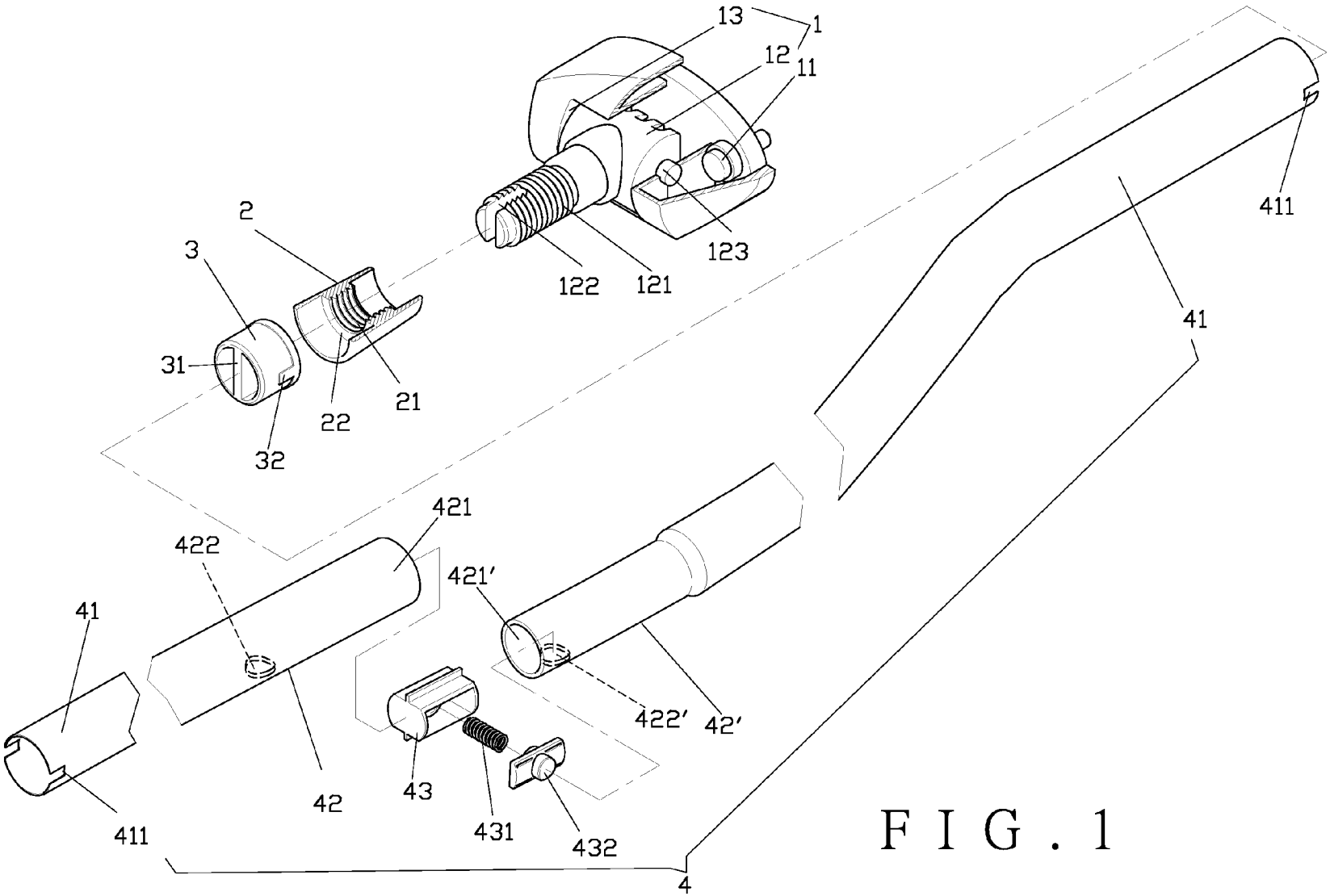
FIG. 1 is an exploded view of the present invention.
Figure 2:
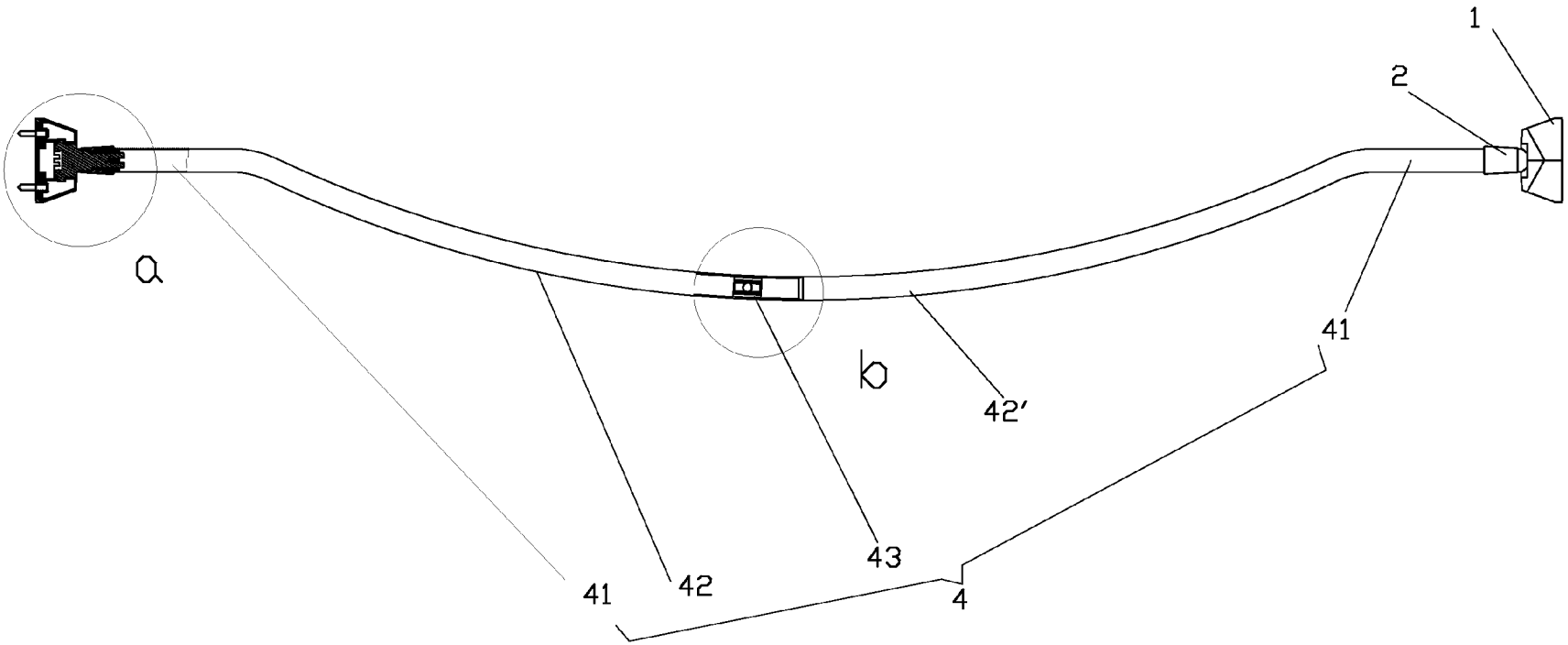
FIG. 2 is a side view of the present invention.
Figure 3:
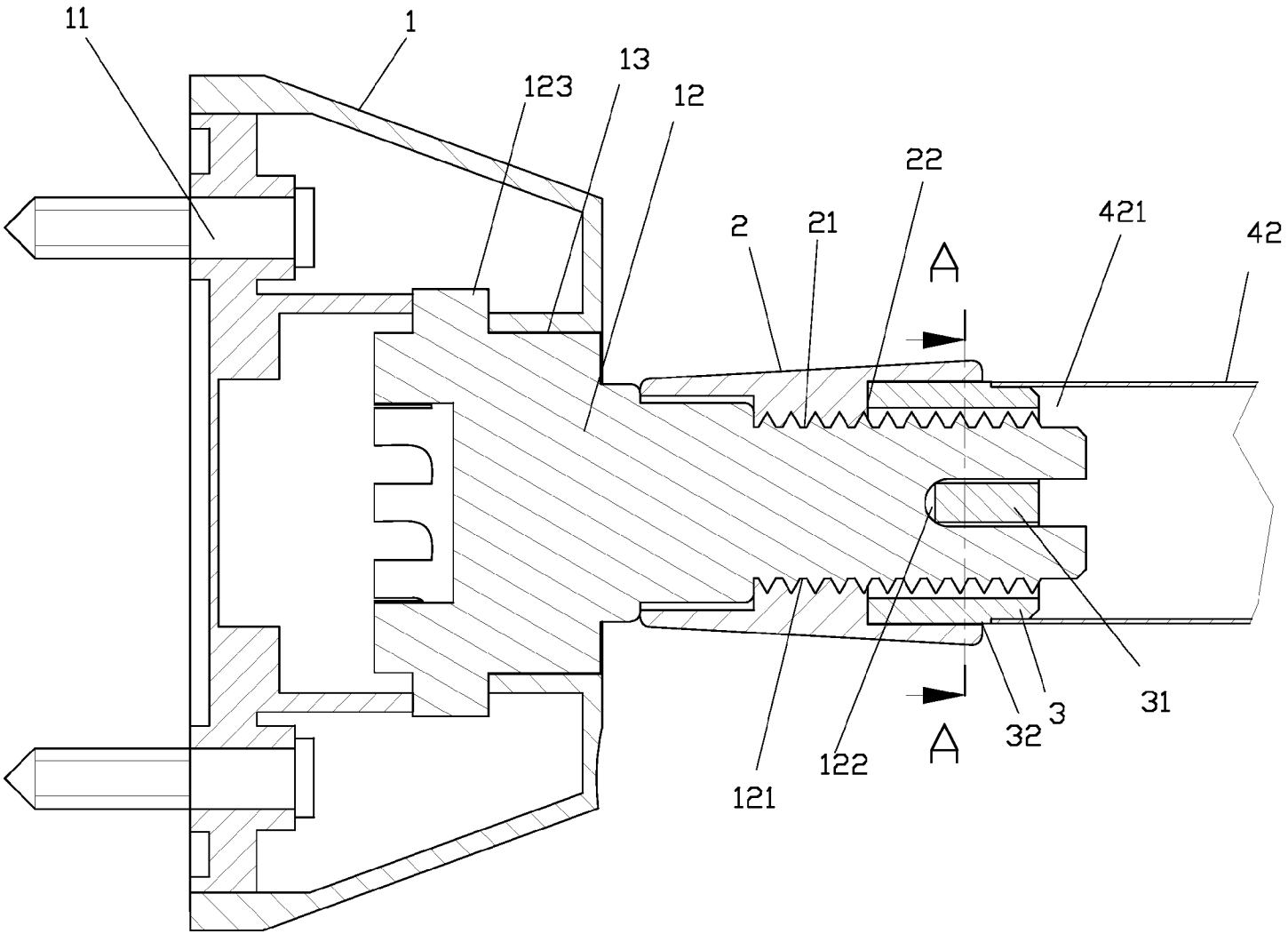
FIG. 3 is an enlarged sectional view, taken along circle a of FIG. 2.
Figure 4:
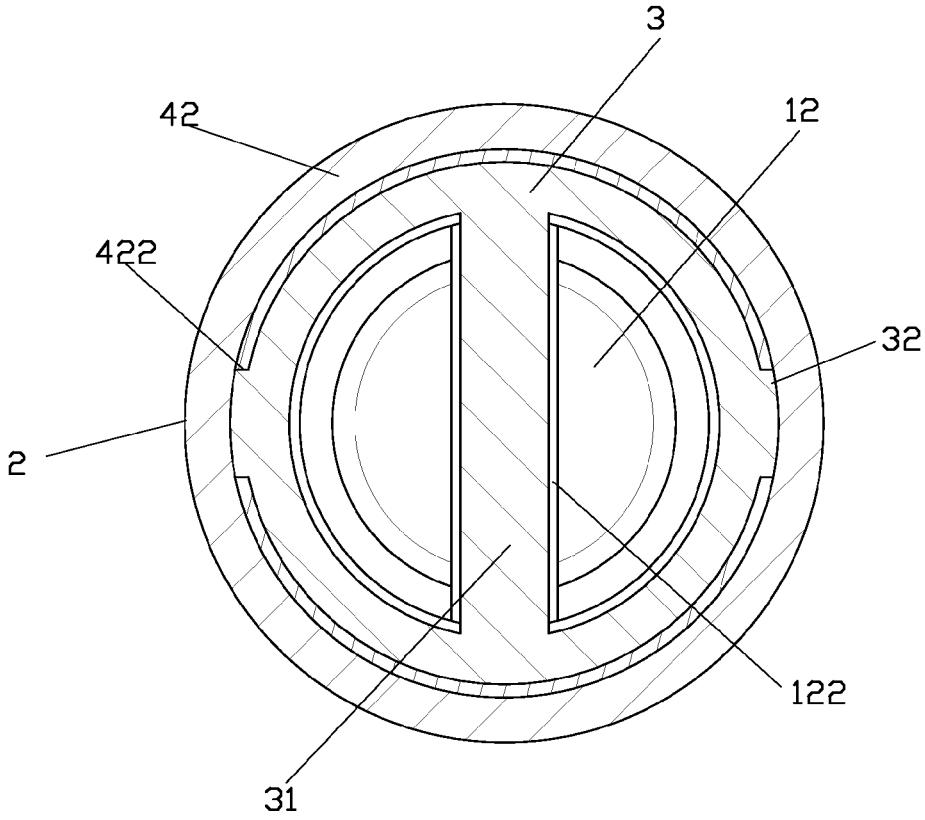
FIG. 4 is a cross-sectional view of the present invention, taken along line A-A of FIG. 3, showing a first socket, a second socket and a linking rod.
Figure 5:
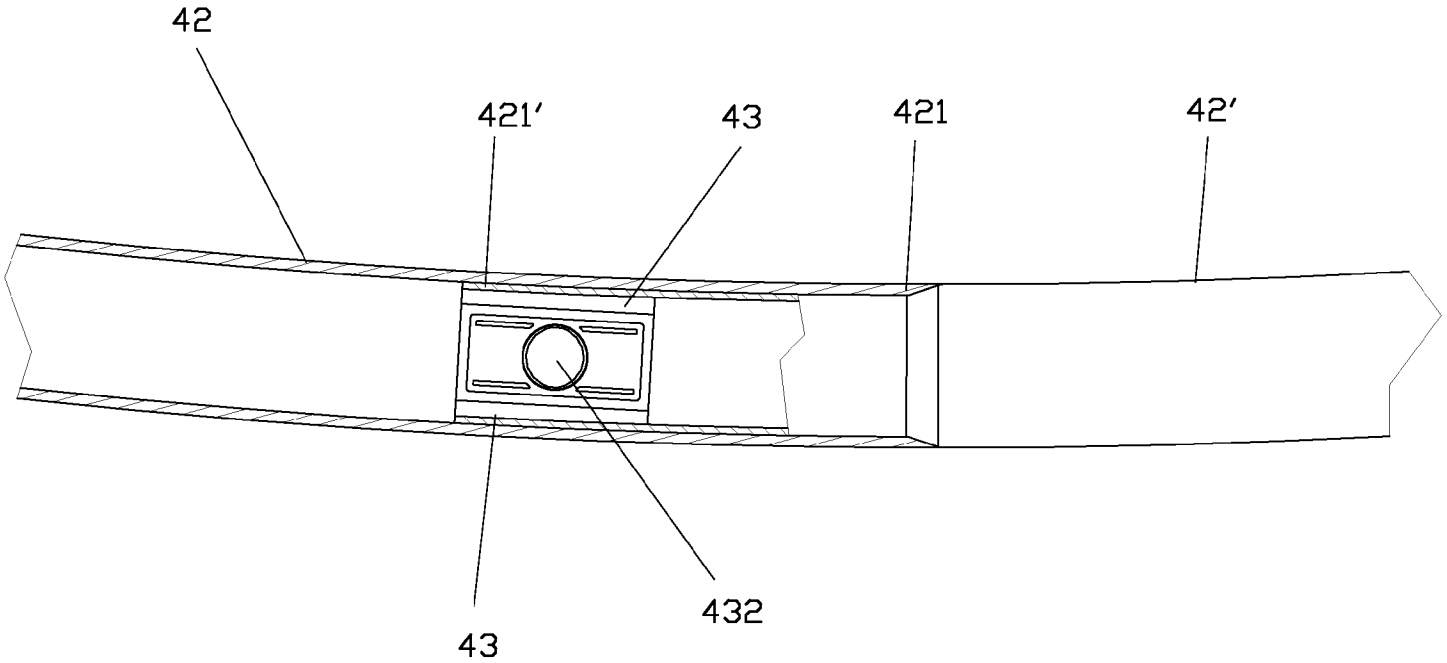
FIG. 5 is a cross-sectional view of the present invention, taken along circle b of FIG. 2, showing the linking rod and a connecting device.
Figure 6:
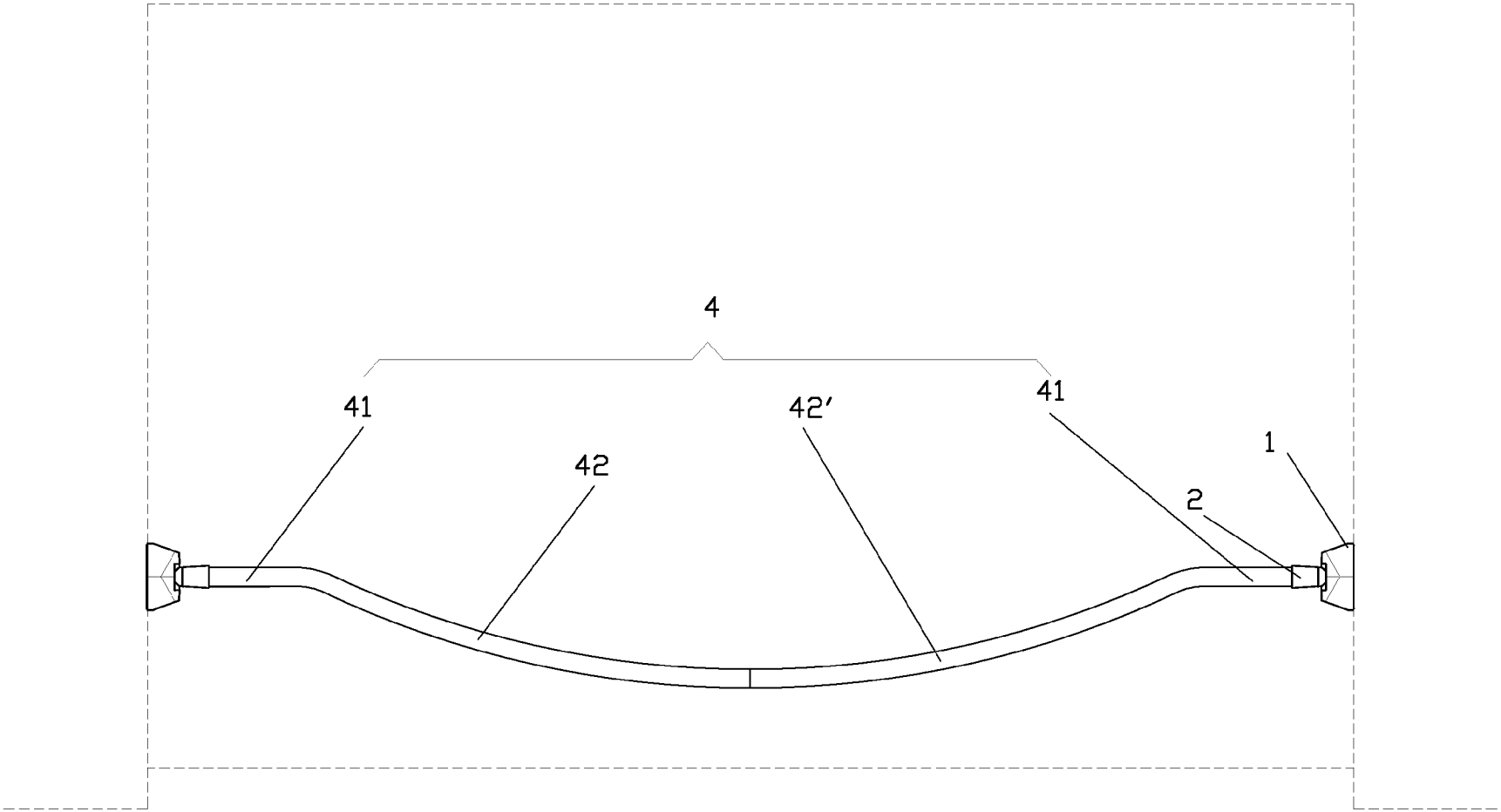
FIG. 6 is a view depicting the present invention mounted on a wall.

As shown in FIGS. 1 and 2, the present invention comprises a pair of fixtures 1, a pair of first sockets 2, a pair of second sockets 3, and a linking rod 4.

The fixture 1 comprises a locking member 11, a connecting unit 12 and a restraining opening 13. The connecting unit 12 has a threaded section 121. A groove 122 is formed at one end of the threaded section 121. The connecting unit 12 is pivotally connected to the fixture 1 by means of a pair of pins 123 at respective sides of the connecting unit 12. The restraining opening 13 is adapted to receive the connecting unit 12 and restrain its turning.

The first socket 2 has inner threads 21 and a neck section 22. The inner threads 21 correspond to the threaded section 121 of the connecting unit 12.

The second socket 3 is accommodated in the first socket 2, and comprises an insertion block 31 for engagement of the groove 122 of the connecting unit 12. The second socket 3 is provided with a pair of protuberances 32 on respective sides thereof.

The linking rod 4 comprises a pair of straight sections 41 at two ends and a first curved section 42 and a second curved section 42' extending from the straight sections 41, respectively. The straight sections 41 are connected to the second sockets 3. Each straight section 41 is formed with a pair of slots 411 for engagement of the protuberances 32 of the second socket 3. A connecting device 43 is adapted for connection of the first and second curved sections 42 and 42'.

One end 421 of the first curved section 42 has a larger diameter than that of one end 421' of the second curved section 42', so that the end 421' can be inserted into the end 421 and connected together as one piece. The ends 421 and 421' of the first curved section 42 and the second curved section 42' are formed with holes 422 and 422'. The connecting device 43 is disposed in the end 421' of the second curved section 42'. The connecting device 43 comprises an elastic element 431 and a lid 432. The lid 432 corresponds to the holes 422 and 422' of the first and second curved sections 42 and 42'.

To assemble the present invention, as shown in FIGS. 3, 4, 5 and 6, the lid 432 of the connecting device 43 is pressed to urge the elastic element 431 inward, and the connecting device 43 is inserted into the end 421' of the second curved section 42' until the lid 432 reaches to the hole 422' and protrudes therethrough to secure the connecting device 43 in the second curved section 42'. The end 421' of the second curved section 42' is inserted into the end 421 of the first curved section 42. The elastic element 431 will be urged again by the lid 432 until the lid 432 reaches to the hole 422. The lid 432 protrudes through the holes 422 and 422' to secure the two curved sections 42 and 42' together.

Figure 7A:
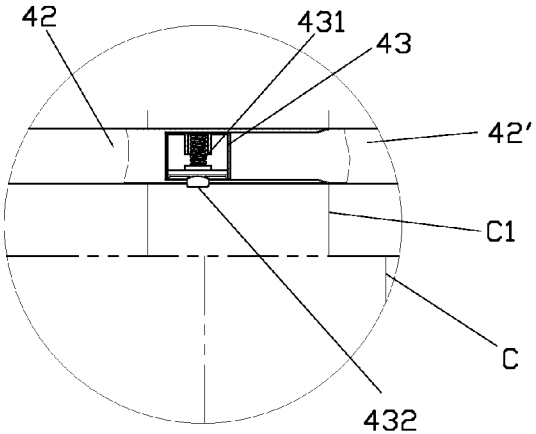
FIG. 7A is an enlarged view, taken along circle c of FIG. 7.
Figure 7:
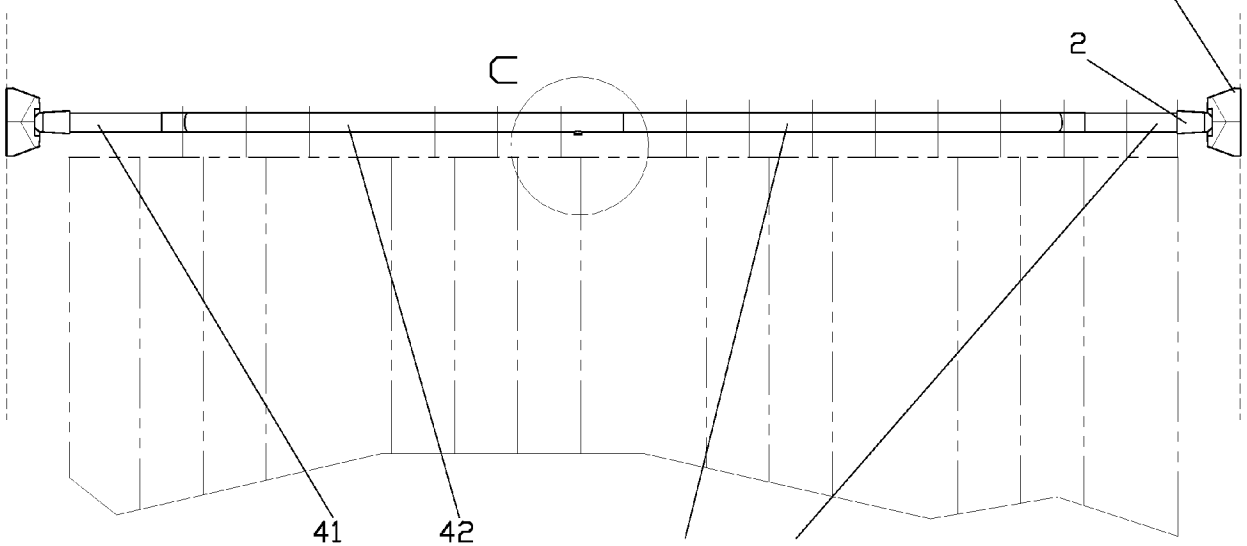
FIG. 7 is a front view of the present invention incorporated with a shower curtain.

The two straight sections 41 of the linking rod 4 are connected to the second sockets 3 in the first sockets 2 and stopped by the neck sections 22. The two fixtures 1 are mounted on the wall. The lid 432 of the connecting device 43 is placed facing down, as shown in FIGS. 7 and 7A. When the present invention is applied to a shower curtain C, the lid 432 does not affect the operation of curtain hooks C1.

Figure 8:
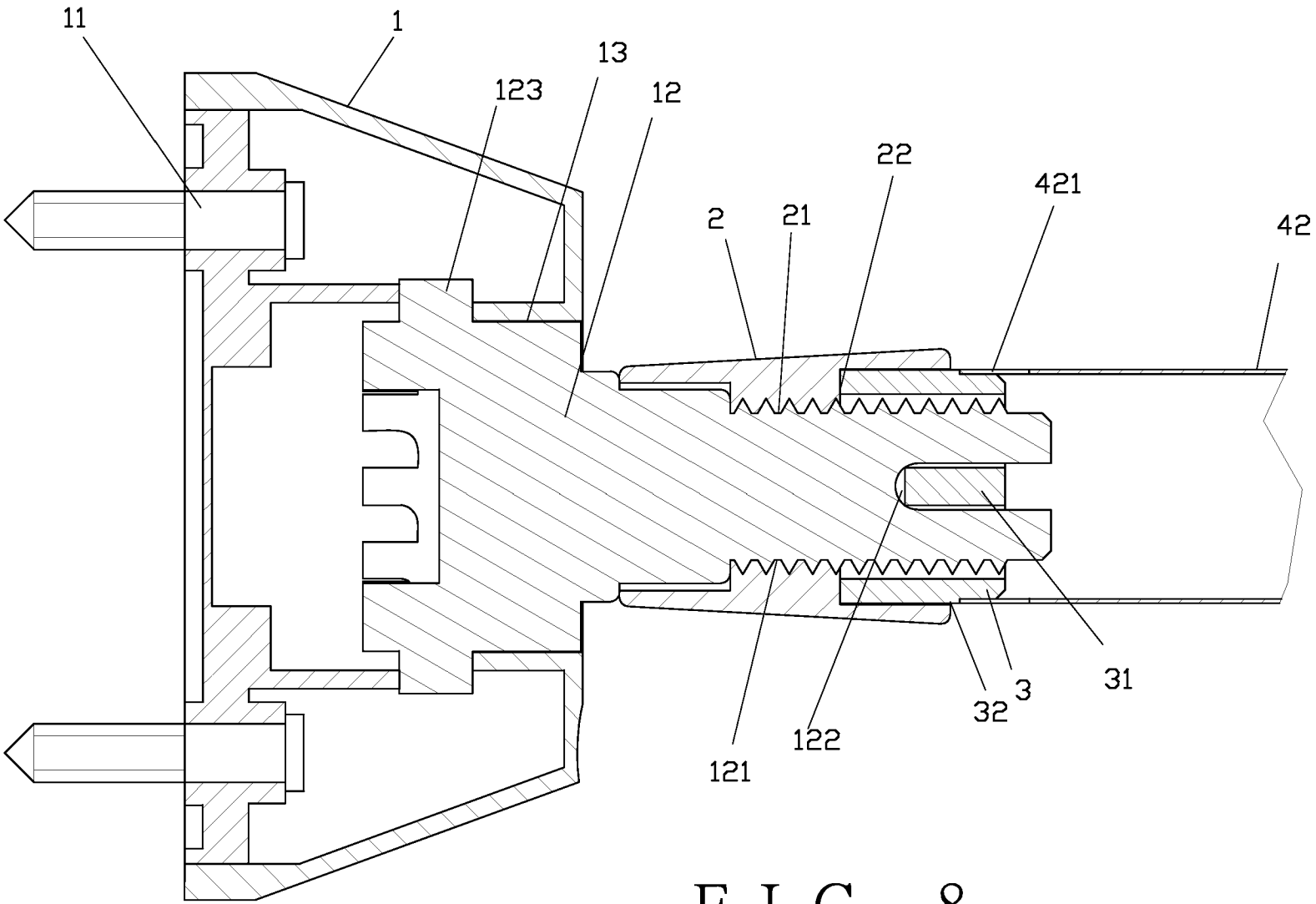
FIG. 8 is a cross-sectional view of the present invention showing that the linking rod is too short to fit into.
Figure 9:
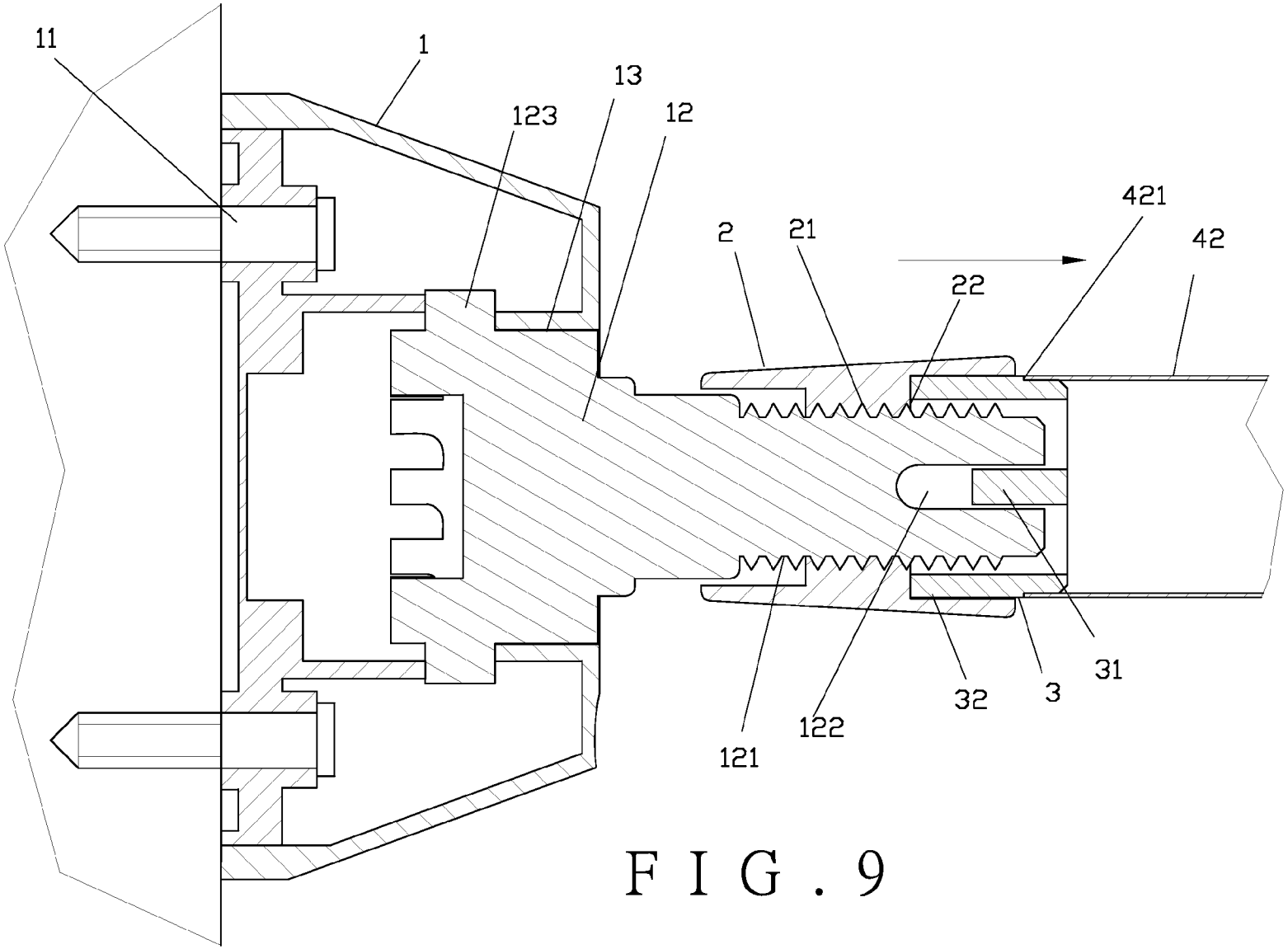
FIG. 9 is a cross-sectional view showing a micro adjustment of the first socket in an appropriate length.
Figure 10:
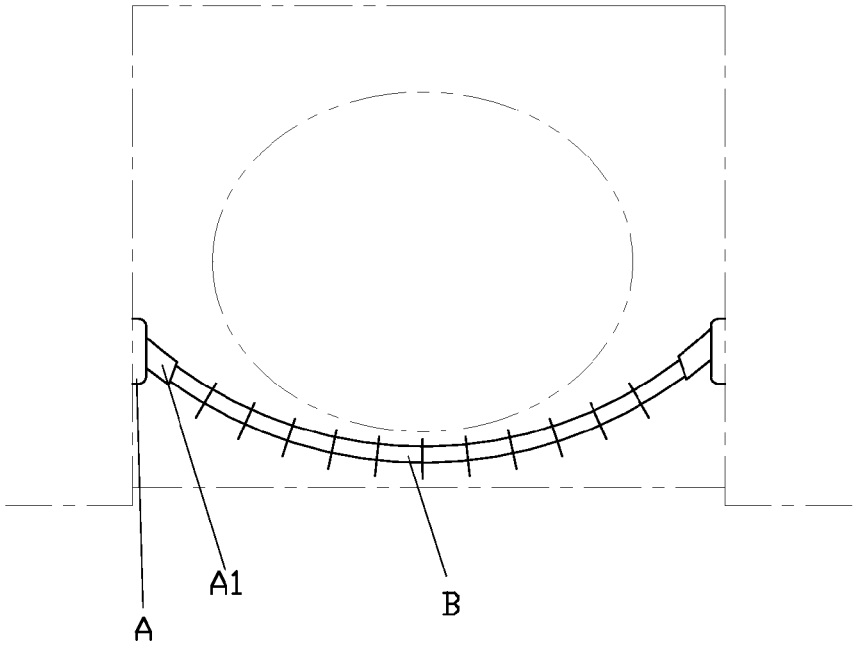
F I G . 10 (PRIOR ART)
FIG. 10 is a top view of a shower curtain hanger of prior art.

As shown in FIGS. 8 and 9, when the linking rod 4 is too short in length and can not reach the neck section 22 of the first socket 2, the first socket 2 will be rotated in relation to the threaded section 122 of the connection unit 12. This forces the neck section 22 to push the second socket 3 outward so as to connect with the straight section 41 of the linking rod 4. The second socket 3 is engaged and secured in the first socket 2. The curtain hanging structure of the present invention is completed.

What is claimed is:

1. A shower curtain hanging structure comprising:

a fixture, said fixture comprising a connecting unit, said connecting unit comprising a threaded section having one end formed with a groove;

a first socket, said first socket having a neck section and inner threads for engagement of said threaded section of said connecting unit;

a second socket accommodated in said first socket, said second socket comprising an insertion block corresponding to said groove of said connecting unit; and a linking rod, said linking rod comprising a pair of straight sections at two ends and two curved sections extending from said straight sections, said straight section being connected to said second socket, a connecting device being disposed between said two curved sections.

2. The shower curtain hanging structure, as recited in claim 1, wherein said connecting unit is pivotally connected to said fixture by means of pins provided at respective sides of said connecting unit.

3. The shower curtain hanging structure, as recited in claim 2, wherein said fixture has a restraining opening to receive and restrain said connecting unit.

4. The shower curtain hanging structure, as recited in claim 1, wherein said fixture is provided with a locking member.

5. The shower curtain hanging structure, as recited in claim 1, wherein one of said two curved sections of said linking rod has a larger diameter end than that of the other curved section for connection of said two curved sections.

6. The shower curtain hanging structure, as recited in claim 1, wherein said two curved sections are formed with holes and said connecting device comprises an elastic element and a lid, said lid being secured in said holes of said two curved sections.

7. The shower curtain hanging structure, as recited in claim 1, wherein said second socket comprises a pair of protuberances on respective outer sides thereof, and said straight sections of said linking rod are formed with slots for engagement of said protuberances.

* * * * *